US005861897A

United States Patent [19]

Ide et al.

[11] Patent Number: 5,861,897

[45] Date of Patent: Jan. 19, 1999

[54] INKJET RECORDING APPARATUS WITH A MEMORY DEVICE DISPOSED SUBSTANTIALLY WITHIN BOUNDARIES IF A RECORDING HEAD UNIT

[75] Inventors: Ichiroh Ide, Kamagaya; Tsutomu Abe, Isehara, both of Japan

[73] Assignee: Canon Kabushiki Kaisha, Tokyo, Japan

[21] Appl. No.: 820,937

[22] Filed: Jan. 15, 1992

[30] Foreign Application Priority Data

Jan. 19, 1991 [JP] Japan ..... 3-004741

[51] Int. Cl.[6] ..... B41J 29/393; B41J 2/175

[52] U.S. Cl. ..... 347/19; 347/86; 347/87

[58] Field of Search ..... 346/140 R; 400/175; 347/19, 49, 86, 87; 361/761, 764, 792

[56] References Cited

U.S. PATENT DOCUMENTS

| | | | |
|---|---|---|---|
| 3,777,221 | 12/1973 | Tatusko et al. | 361/761 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,635,080 | 1/1987 | Watanabe | 347/49 X |
| 4,723,129 | 2/1988 | Endo et al. | 347/56 |
| 4,740,796 | 4/1988 | Endo et al. | 347/56 |
| 4,875,057 | 10/1989 | Hediger et al. | 347/242 |
| 4,977,459 | 12/1990 | Ebinuma et al. | 358/296 |
| 5,039,237 | 8/1991 | Tanuma et al. | 400/175 X |
| 5,049,898 | 9/1991 | Arthur et al. | 347/19 |
| 5,097,117 | 3/1992 | Champagne et al. | 235/488 |
| 5,155,502 | 10/1992 | Kimusa et al. | 347/87 |

FOREIGN PATENT DOCUMENTS

| | | | |
|---|---|---|---|
| 59-123670 | 7/1984 | Japan | B41J 3/04 |
| 59-138461 | 8/1984 | Japan | B41J 3/04 |
| 1-034746 | 2/1989 | Japan | B41J 3/04 |

OTHER PUBLICATIONS

Webster's Ninth New Collegiate Dictionary, p. 56 (1987).

*Primary Examiner*—David F. Yockey

*Attorney, Agent, or Firm*—Fitzpatrick, Cella, Harper & Scinto

[57] ABSTRACT

A recording head unit includes a base plate with a cut-out portion (or slot or through hole). A printed circuit board has a memory device attached to it and the printed circuit board is joined to the base plate with the memory device in the cut-out portion. The memory device is thinner than the base plate and fits completely within the cut-out portion, so that it is disposed wholly within the boundaries of the recording head unit. A recording cartridge includes a recording head unit and an ink tank for supplying ink to the recording head unit which are joined together, and a memory device which is substantially enclosed by joining the recording head unit and the ink tank.

16 Claims, 12 Drawing Sheets

111

111
112

128
115

115
128
111
112
BASE PLATE
WASH
JOIN HEATER BOARD
JOIN PRINTED CIRCUIT BOARD
HEATER BOARD
PRINTED CIRCUIT BOARD
WASH
SEMICONDUCTOR CHIP (ROM)

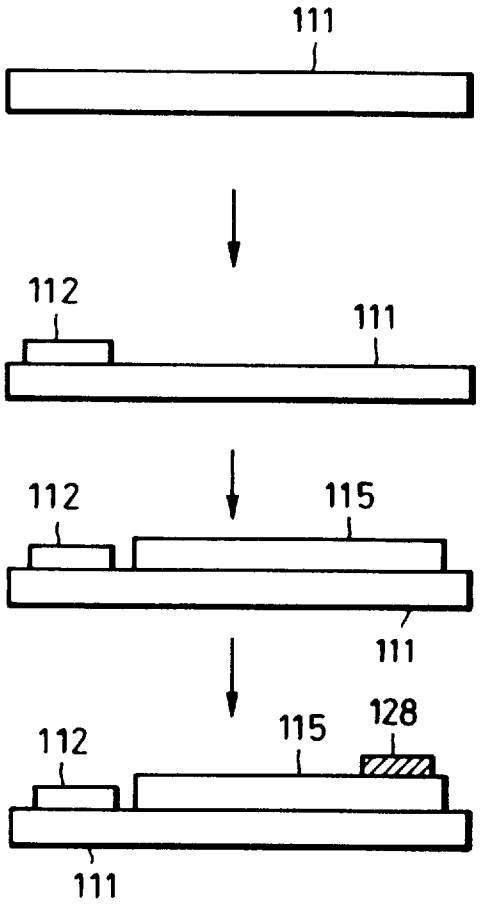
FIG. 12(a) PRIOR ART
FIG. 12(b) PRIOR ART
FIG. 12(c) PRIOR ART
FIG. 12(d) PRIOR ART
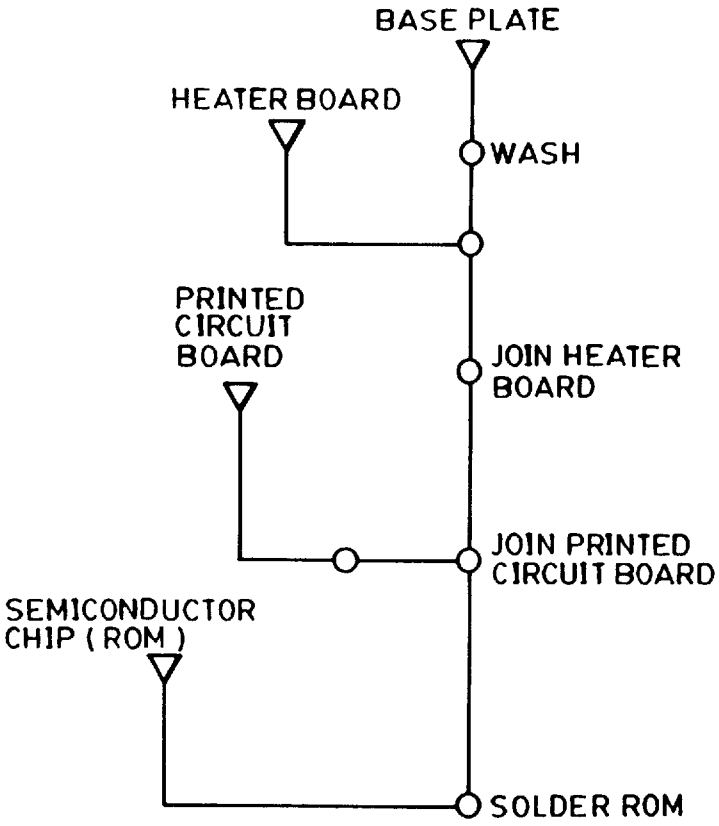
FIG. 12(e) PRIOR ART

INKJET RECORDING APPARATUS WITH A MEMORY DEVICE DISPOSED SUBSTANTIALLY WITHIN BOUNDARIES IF A RECORDING HEAD UNIT

BACKGROUND OF THE INVENTION

1. Field of the Invention

The present invention relates to a recording head, an ink tank and a recording head cartridge capable of being loaded into a recording apparatus, such as a printer, a facsimile apparatus or a copying machine, and a recording apparatus having the recording head, the ink tank and the recording head cartridge, and more particularly, to a recording head having a device including or capable of including information on recording conditions, an ink tank, a recording head cartridge, and a recording apparatus loaded with the recording head, the ink tank and the recording head cartridge.

2. Description of the Related Art

An ink jet recording method which records by jetting droplets of ink (recording liquid) onto a recording medium, such as paper, has attracted attention and been put into active development and study because it creates virtually no noise while recording and it can record on plain paper at high speed without any special processing such as fixing.

A recording head applicable to such an ink jet recording apparatus is generally provided with a fine liquid jetting outlet (orifice), a liquid path connected to the liquid jetting outlet, an energy acting portion disposed in the liquid path, and a droplet energy generating portion for making liquid in the energy acting portion act.

The energy is generated by, for example, using an electromechanical converter, such as a piezo-electric device, or radiating an electromagnetic wave like a laser beam onto the liquid and jetting droplets of the liquid by a heating action of the laser beam. In particular, an ink jet recording head having an electricity-heat converter as an energy generating means can achieve high-resolution recording since liquid jetting outlets (orifices) for jetting recording droplets to form flying droplets can be arranged densely in such a head. Furthermore, the recent application of IC (semiconductor) technology and micro manufacturing technology have made it possible to provide an ink jet recording head having multiple nozzles, arranged at high density which is capable of being mass-produced, and advantageous in productivity and cost.

Recently, using an ink jet recording head cartridge freely detachable from a recording apparatus, and a plurality of recording head cartridges of different colors for color printing has been suggested.

In the case of an ink jet recording head cartridge detachable from a recording apparatus, characteristics, such as loading conditions of the recording head cartridge into the apparatus, colors and density of ink used in the recording head cartridge, driving conditions of the recording head cartridge and the amount of residual ink, differ with the recording head cartridge (also the ink tank and the head), and it is necessary to change a recording operation in accordance with the characteristics.

U.S. Pat. No. 5,049,898 discloses a recording head cartridge having a memory device for storing information on such characteristics.

The ink jet recording head having a memory device is produced in, for example, the following processes.

FIG. 12 is an explanatory view showing the production procedures of a substrate in an ink jet recording head according to the related art.

First, a base plate 111 (a first substrate) made of glass, ceramics, plastic or metal is washed (FIG. 12(*a*)). Then, as shown in FIG. 12(*b*), a heater board 112 (a second substrate) on which an ink jet pressure generating device (an ink jet energy generating device for generating energy to be used to form ink droplets), such as a heating element serving as an electricity-heat converter or a piezo-electric device serving as an electromechanical converter, is formed is joined to a predetermined position on the base plate 111 with a UV curing adhesive or the like. After that, a printed circuit board 115 (a third substrate) for electrically connecting the ink jet pressure generating device and the body of a printer is joined onto the base plate 111. Finally, a semiconductor chip 128 (ROM) serving as a memory device for storing, for example, data on the above characteristics is soldered to the side of the printed circuit board 115 opposite to the side connected to the base plate 111 (FIG. 12(*d*)). The above production processes of a recording head are generally carried out on an automated line represented schematically in FIG. 12(*e*).

However, according to the construction disclosed in U.S. Pat. No. 5,049,898, a ROM serving as a memory device is affixed to a housing of an ink jet head cartridge. Such construction has the following problems.

If information stored in the memory device is wrong, the operation of a recording apparatus and the driving state of a recording head are hindered and an image is damaged. In an extreme case, recording will be impossible. When such a delicate memory device thus affixed to the housing of the recording head cartridge is exposed, it can be damaged by direct impact when being transported, from being touched by a user, and so on, when the recording head cartridge is detached from the recording apparatus.

Furthermore, since the ink jet head cartridge contains liquid ink, leakage of the ink in transportation and scattering of the ink in recording may hinder proper operation of the memory device and its peripheral circuits.

On the other hand, there are the following problems in the production of the ink jet head.

When the recording head substrate is produced as shown in FIG. 12, and the semiconductor chip 128 serving as a memory device is soldered after the base plate 111 and the printed circuit board 115 are joined as shown in FIG. 12(*d*), the semiconductor chip 128 projects from the printed circuit board 115. Therefore, for example, it is difficult to horizontally pile such recording head substrates in a storage device like a magazine in the production process. As a result, the construction required to supply the substrates in an automatic assembly process is complicated. In addition, the projecting semiconductor chip may be caught in the production process, damaged and break down.

When another semiconductor chip is soldered onto the printed circuit board 115, since the heater board 112 is already affixed onto the base plate 111, refuse material arising from the soldering of the semiconductor chip may damage the heater board 112 and block the jetting outlets. Furthermore, the refuse material may move to the ink jet pressure generating device, an electrode and a transistor formed on the heater board 112 after the soldering and cause the leakage of current from the semiconductor, and the refuse material remaining in a liquid path, a liquid chamber and an orifice may make ink jetting unstable or impossible.

In order to prevent the soldering refuse material from soiling the heater board 112, it is necessary to wash the semiconductor chip 128 after soldering. However, since the semiconductor chip 128 and the heater board 112 have been already coupled with each other at the time of soldering, such washing is difficult.

SUMMARY OF THE INVENTION

An object of the present invention is to solve the above problems and to provide a recording head and a recording head cartridge capable of preventing a memory device loaded in the recording head and the recording head cartridge from being damaged when the recording head or the recording head cartridge is produced, transported or used, and a method of producing the ink recording head and the ink recording head cartridge.

Another object of the present invention is to provide a recording head substrate capable of being horizontally piled in a magazine and easily being supplied as a work piece in automatic assembly in other production processes without causing any damage to a memory device, and a method of producing the recording head substrate.

Still another object of the present invention is to provide a method of producing a recording head substrate in which dirt due to soldering and so on in production does not have any adverse influence on a heater board.

In order to achieve the above objects, the present invention selects an optimal position and method of mounting a memory device on a recording head substrate.

The present invention has a construction in which a memory device is disposed at an optimal position in an ink jet recording head or an ink jet head cartridge so as to be protected, thereby preventing the memory device from being damaged.

According to the present invention, since a semiconductor chip is placed in, for example, a cut portion, a slot or a through hole of a base plate, a recording head substrate can be made compact. Furthermore, since the memory device does not project, recording head substrates can be horizontally piled in a storage portion, such as a magazine.

Still furthermore, since a semiconductor chip is soldered to a printed circuit board and washed, and then a base plate and the printed circuit board are joined, it is possible to prevent a heater board from being damaged by dirt arising from the soldering of semiconductor chip and so on.

According to one aspect of the present invention, there is provided an ink jet recording head unit which comprises a jetting outlet for jetting ink therethrough, an ink channel connected to the jetting outlet, and an energy generating device for generating energy to jet the ink in the ink channel, and which further comprises a memory device for storing conditions, such as driving conditions of the energy generating device, the memory device being substantially contained in the recording head unit, or there is provided an ink jet recording head unit which comprises a jetting outlet for jetting ink therethrough, an ink channel connected to the jetting outlet, an energy generating device for generating energy to jet the ink in the ink channel, a first substrate formed with a cut portion, a slot portion or a through hole, a second substrate formed with the energy generating device and disposed at a predetermined position on the first substrate, and a third substrate formed with a semiconductor device and electrically connected to the second substrate, the first and third substrates being coupled and the semiconductor device being disposed in the cut portion, the slot portion or the through hole.

According to another aspect of the present invention, there is provided an ink jet recording head cartridge which comprises an ink jet recording head for recording by jetting ink and an ink tank for supplying the ink to the recording head, the recording head having a jetting outlet for jetting the ink, an ink channel connected to the jetting outlet, an energy generating device for generating energy required to jet the ink, and a memory device for storing conditions, such as driving conditions of the energy generating device, and being covered by joining the recording head and the ink tank.

According to a further aspect of the present invention, there is provided a recording apparatus which comprises a jetting outlet for jetting ink, an ink channel connected to the jetting outlet, an energy generating device for generating energy to jet the ink in the ink channel, and a memory device for storing conditions, such as driving conditions of the energy generating device, the memory device having a signal supply means for supplying a signal to drive a recording head cartridge and the energy generating device.

According to still further aspect of the present invention, there is provided a method of producing a recording head unit which comprises the steps of joining a second substrate having a heating element for jetting ink onto a first substrate, joining a semiconductor device onto a third substrate serving as an electric circuit substrate, washing the third substrate coupled with the semiconductor device, and joining the first and third substrates.

BRIEF DESCRIPTION OF THE DRAWINGS

FIGS. 12(*a*)–12(*e*) are explanatory views, showing the production procedures of a recording head substrate according to the related art.

DESCRIPTION OF THE PREFERRED EMBODIMENTS

Preferred embodiments of the present invention will now be described with reference to the accompanying drawings.

Figure 1:
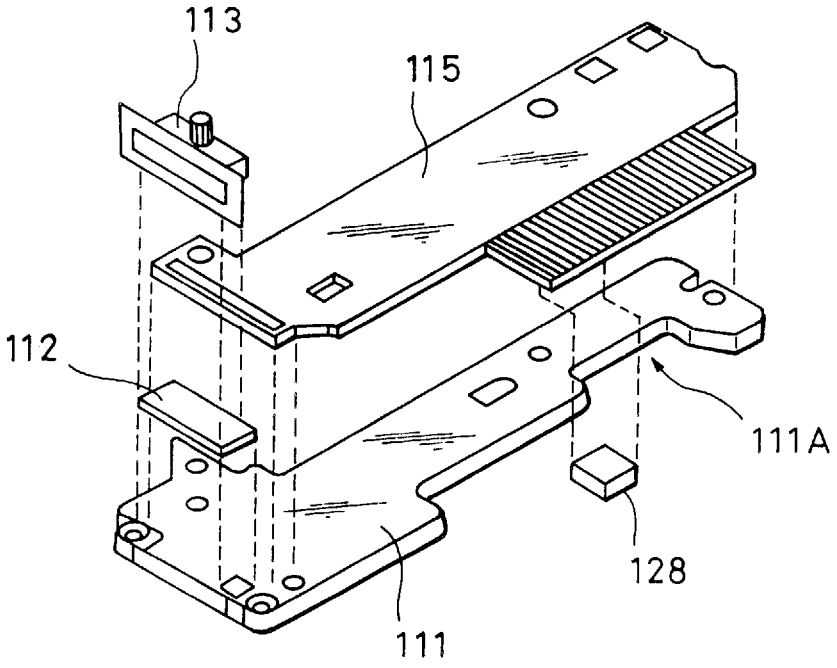
FIG. 1 is an exploded perspective view of a recording head according to an embodiment of the present invention.

FIG. 1 is an exploded perspective view of the principal part of a recording head unit.

The principal part of the recording head unit has a construction that prevents a memory device that stores information relating to the unit from being damaged in a production process and affected by scattering of ink.

Referring to FIG. 1, the recording head unit is provided with a base plate or first substrate 111 formed with a cut portion 111A, a or second substrate 112 formed with an ink jet energy generating device, such as an electricity-heat converter, a printed circuit board or third substrate 115 which electrically connects the energy generating device and the body of a printer and both sides of which are wired, and a semiconductor chip 128 soldered to the back of the printed circuit board 115 as a component of a ROM serving as a memory device. It will, of course, be understood that soldering the semiconductor chip 128 to the back of the printer circuit board 115 electrically connects the chip to the board.

When the printed circuit board 115 is joined to the base plate 111, the semiconductor chip 128 is located in the cut portion 111A of the base plate 111. At this time, since the thickness of the attached components, such as the semiconductor chip 128 and a condenser, is less than that of the base plate 111, they are disposed substantially within the boundaries of the resulting head unit and thus do not project from the base plate 111. As a result, the attached components can be horizontally piled in a magazine or the like. Furthermore, since the components do not project, it is unlikely that they will be caught and that the semiconductor chip 128 and so on will be damaged.

It is preferable that the printed circuit board 115 be joined to the base plate 111 at a portion thereof where a wiring pattern is not formed in order to prevent the influence of an adhesive or the like on a wiring pattern.

A top plate 113 having a plurality of slots for forming channels and a common liquid chamber connected to the channels is laid on the heater board 112. The top plate 113 integrally has a front plate (orifice plate) formed with ink jetting outlets respectively connected to the channels. When the base plate 113 is joined to the base plate 111 after aligning the jetting outlets with the channels, ink supply inlets, ink channels, ink chambers and ink jetting outlets are formed.

Although the base plate 111 has the cut portion 111A in this embodiment, it may have a slot or a through hole so as to contain the semiconductor chip 128 therein. In this case, if the thickness of the semiconductor chip 128 is less than that of the base plate 111, the semiconductor chip 128 does not project from the base plate 111.

Figures 2A, 2B, 2C, 2D, 2E:
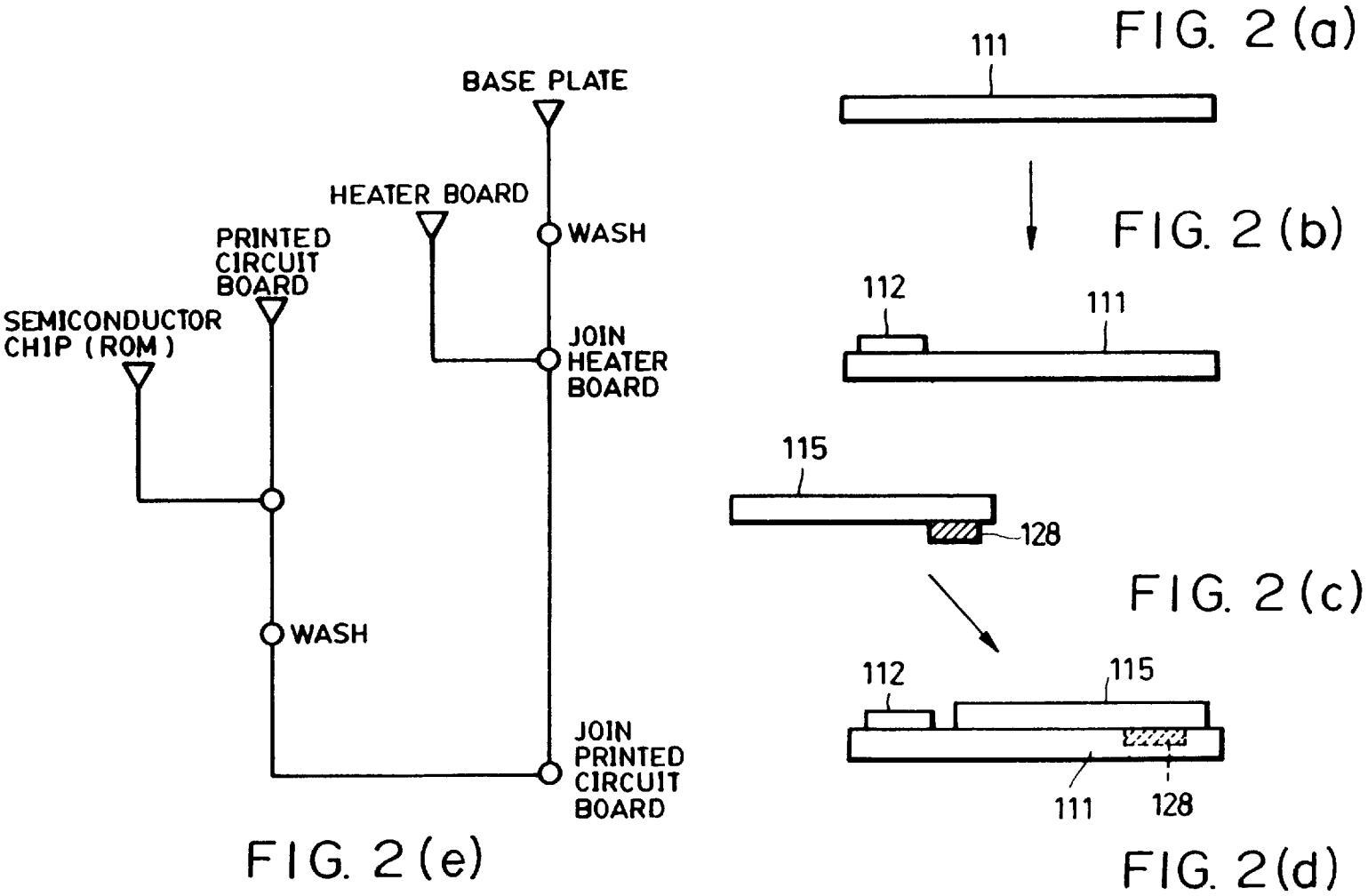
FIGS. 2(*a*)–2(*e*) are explanatory views, showing production procedures of a recording head substrate according to such embodiment.

The method of producing a recording head substrate as a component of the recording head unit according to this embodiment will now be described with reference to FIG. 2. The left-hand part of FIG. 2, that is, FIG. 2(*e*) illustrates production processes, and FIGS. 2(*a*) to 2(*c*) in the right-hand part illustrate the states of the recording head substrate in the processes.

First, the base plate 111 is washed (FIG. 2(*a*)). Then, as shown in FIG. 2(*b*), the heater board 112 is joined onto the base plate 111 with a UV curing adhesive or the like. On the other hand, the semiconductor chip 128 is soldered to the back of the printed circuit board 115, the printed circuit board 115 attached with the semiconductor substrate 128 FIG. 2(*c*) is washed to remove soldering refuse materials, contaminants, flux and so on. Finally, as shown in FIG. 2(*c*), the base plate 111 and the printed circuit board 115 are joined with a UV curing adhesive or the like so that the semiconductor chip 128 soldered to the back of the printed circuit board 115 is placed in the cut portion 111A (shown in FIG. 1) of the base plate 111.

According to the above processes, since the refuse material, dirt, flux and so on can be removed by washing the printed circuit board 115 after the step of soldering the semiconductor chip 128 to the printed circuit board 115, it is possible to prevent adverse influences on the heater board 112 laid on the base plate 111. In other words, since the current of a semiconductor will not leak due to transfer of the soldering refuse materials and so on to the electrode of the ink jet pressure generating device, the transistor and so on formed on a semiconductor substrate as a component of the heater board 112, and they do not remain in the channels, the chambers and the orifices, it is possible to prevent ink jetting from being unstable or impossible. Therefore, a recording head substrate having high reliability can be provided.

After the above processes are completed, the heater board 112 and the printed circuit board 115 are connected by wire bonding or the like. Then, the secondary processing, such as reference plane figuring, is conducted on the base plate 111, and the top plate 113 is affixed.

The constructions of a head unit and a head cartridge, each of which is loaded with a recording head substrate formed using the above processes and protects a memory device and so on, will now be described.

(1) Head Cartridge (1.1) General Description

Figure 3:
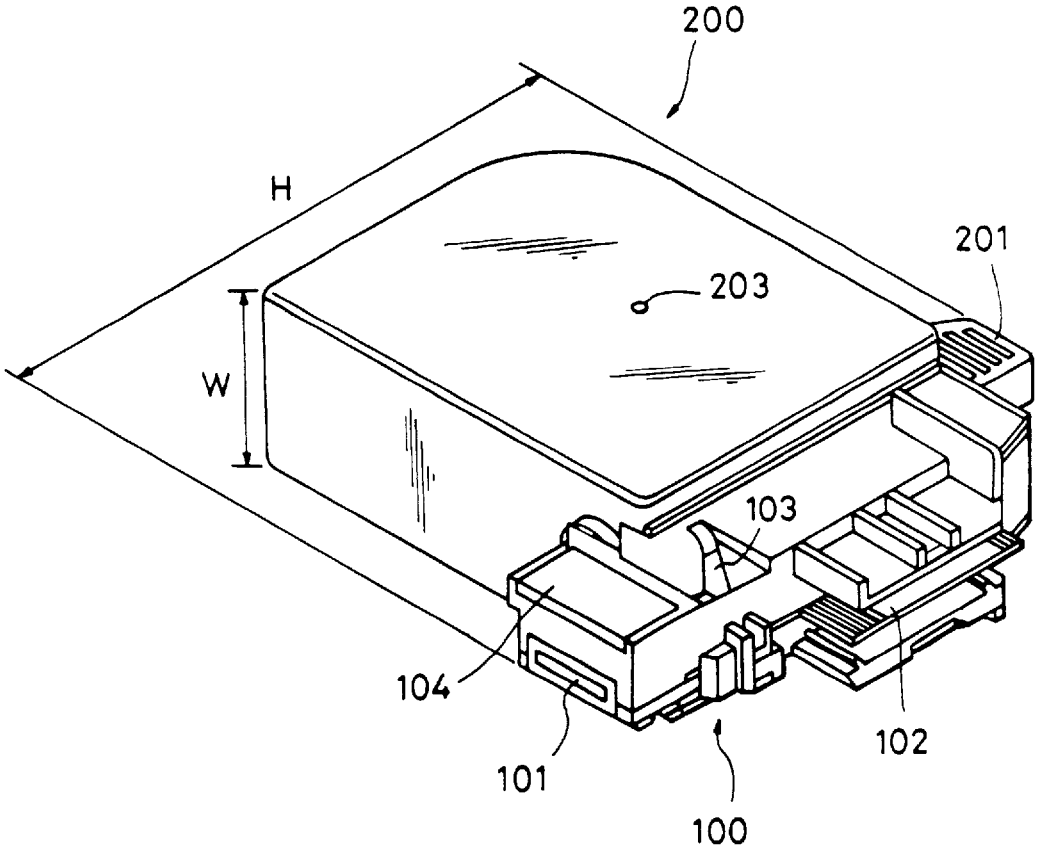
FIG. 3 is a perspective view showing the outside configuration of a head cartridge capable of being loaded into a carriage of an ink jet recording apparatus according to such embodiment.

FIG. 3 shows the construction of a head cartridge capable of being loaded into a carriage of an ink jet recording apparatus according to the present invention. The cartridge integrally includes an ink tank unit 200 and a head unit 100, and the head unit 100 is detachable from the ink tank unit 200 as described below. A wire connector 102 for receiving a signal to drive an ink jetting portion 101 and outputting a residual ink amount detection signal is disposed next to the head unit 100 and the ink tank unit 200. Therefore, when this cartridge is mounted in a carriage described below, the height H and width W of the cartridge can be made smaller. This makes it possible to make the carriage compact where a plurality of recording head cartridges are arranged therein.

As for the loading of the head cartridge, the user grips a knob 201 formed in the ink tank unit 200 and mounts the head cartridge, in which the jetting portion 101 lies face down, on the carriage. A pin of the carriage engages a pin engaging portion 103 of the head unit 100, thereby positioning the head unit 100. The positioning will be described below.

In the head cartridge according to this embodiment, an absorber 104 for cleaning a member for wiping the surface of the ink jetting portion 101 is disposed in the same direction as that of the surface of the ink jetting portion 101 so that at least a part of the absorber 104 is exposed. A ventilating hole 203 for letting air into the ink tank unit 200 in correlation to the consumption of the ink is formed in almost the center of the ink tank unit 200.

Figure 4:
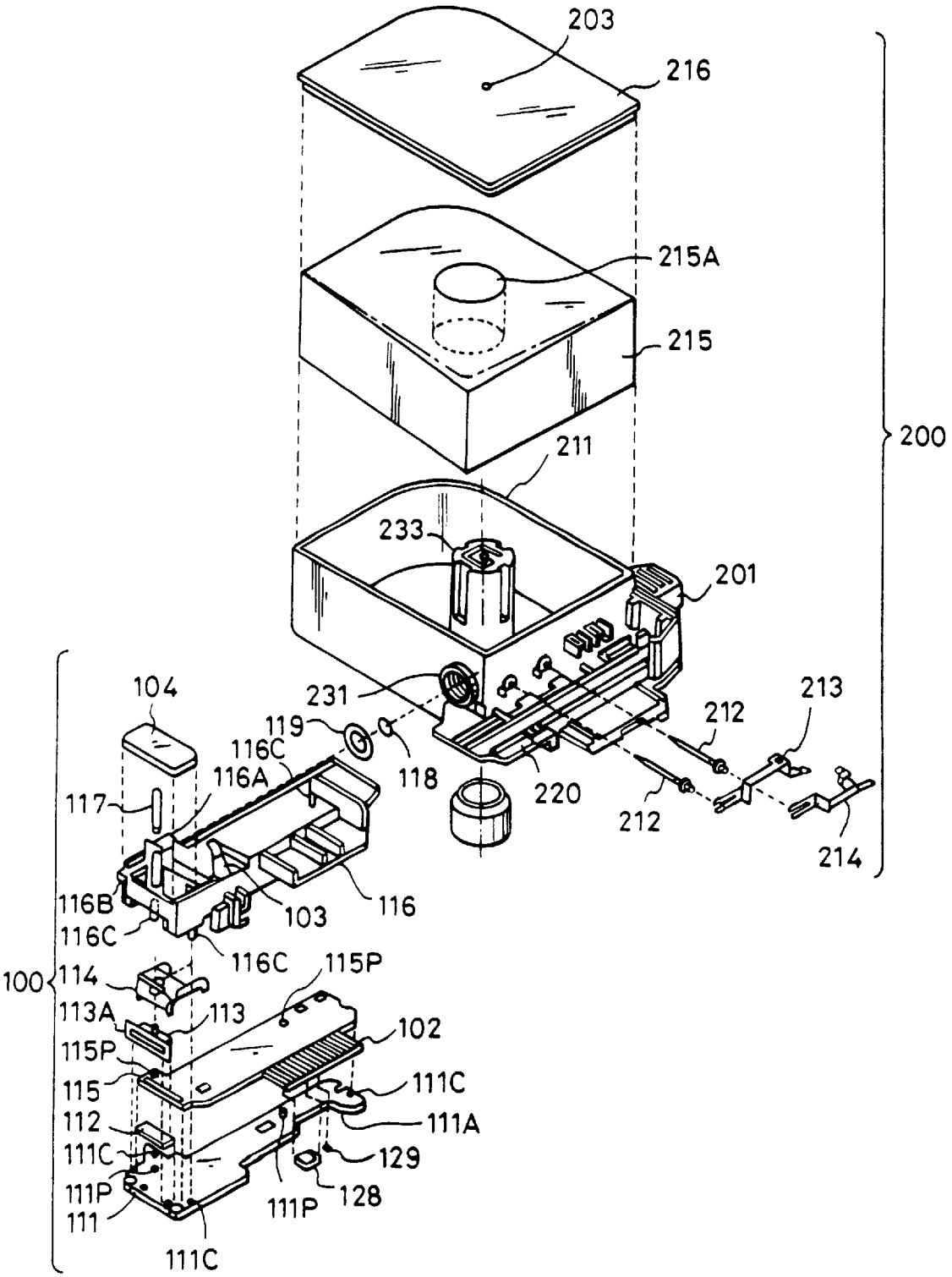
FIG. 4 is an exploded perspective view of the head cartridge.

FIG. 4 is an exploded perspective view of the head cartridge shown in FIG. 3. The head cartridge is constituted by the head unit 100 and the ink tank unit 200, and the detailed construction of these units will be described with reference to FIG. 4.

(1.2) Head Unit

As the base of the packaging of components of the head unit 100, the base plate 111 made of metal, such as aluminum, is used. The substrate (base) 112 having energy generating elements for generating energy used to jet the ink and the printed circuit board (PCB) 115 having wires for supplying electricity to the elements are mounted on the base plate 111, and connected by wire bonding or the like. On the substrate 112, 128 electricity-heat conversion elements, as the energy generating elements for generating heat energy to cause film boiling in the ink according to the electricity supply timing based on a facsimile signal, a read signal from a copying machine, or a recording signal from a host, are arranged in line. The arrangement and number of the electricity-heat conversion elements are not particularly limited. Although the electricity-heat conversion elements are suitable as the energy generating elements in order to make the recording head compact, other elements, for example, piezo-electric elements may be also used. The substrate 112 will be referred to as a "heater board" hereinafter.

The above-mentioned wire connector 102 forms a part of the PCB 115. A drive signal from an unillustrated control circuit on the side of the apparatus body is received by the wire connector 102, and supplied to the heater board 112 through the PCB 115. The PCB 115 in this embodiment is a double-faced wiring board, and is provided with semiconductor devices, for example, an IC 128 in the shape of a ROM electrically connected thereto as the above memory device for storing information peculiar to the head, such as an appropriate condition for driving the electricity-heat conversion elements, the ID number, information on the color and density of the ink, data for correcting the drive conditions (head shading (HS) data, a PWM control condition, and a condition for changing a recording signal, and a condenser 129.

Figure 5:
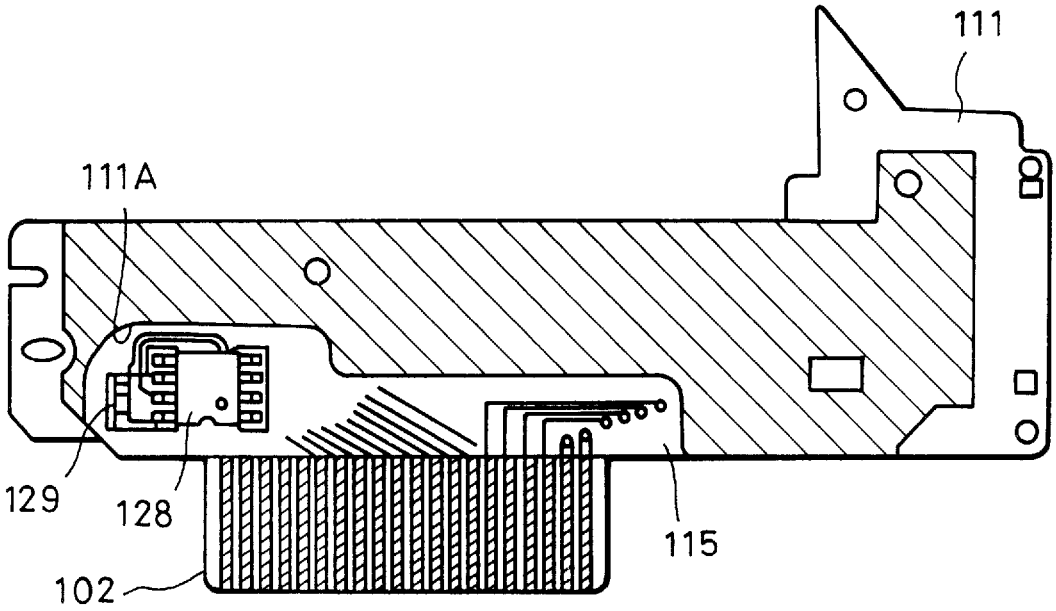
FIG. 5 is a plan view explaining the joint relation between a base plate and a PCB in a head unit of the head cartridge.

FIG. 5 is a bottom view of a unit of the base plate 111 and the PCB 115. The PCB 115 is outlined by a solid line and the base plate 111 is hatched. As shown in the figure, the memory device 128 and the condenser 129 are located in a portion corresponding to the cut portion 111A of the base plate 111 on the side of the PCB 115 connected to the base plate 111, and the three sides of the memory device 128 are surrounded by the base plate 111.

Thus, if the heights of the attached IC 128 and so on are less than the thickness of the base plate 111, the IC and so on do not project when the PCB 115 and the base plate 111 are joined. Therefore, it is unnecessary to consider the housing state in accordance with the projection in the production process, and to worry about damage to the projecting components, such as the IC. Furthermore, if the base plate 111 is made of metal, such as aluminum, since it is disposed near the memory device and so on, the memory device is shielded from harmful electromagnetic waves from outside and inside the apparatus.

The top plate 113 having recessed portions for forming a common liquid chamber which temporarily stores the ink supplied from the ink tank unit 200 and liquid channels linking the liquid chamber and jetting outlets is mounted on the heater board 112. The top plate 113 is integrally formed with a jetting outlet forming member (orifice plate) 113A having ink jetting outlets. A presser spring 114 applies a constant pressure (linear pressure) adjacent to the jetting outlets in order to form the jetting portion 101 by bringing the top plate 113 and the heater board 112 into close contact with each other.

As described above, since the ink supply path from outside the recording head unit to the liquid channels (ink channels) and so on are mounted on the side of the PCB 115 reverse to the side where the semiconductor devices, such as a ROM and a condenser are arranged, the semiconductor devices are unlikely to be damaged. Furthermore, even if the ink leaks out of the ink supply path and so on, the semiconductor devices are not affected.

Referring to FIG. 4 again, a head unit cover 116 is integrally formed by molding with an ink supply pipe 116A leading into the ink tank unit 200, an ink channel 116B linking the ink supply pipe 116A and an ink lead-in pipe of the top plate 113, three pins 116C for positioning and fixing the head unit cover 116 to the base plate 111, the pin engaging portion 103, an attachment portion for the absorber 104 and other necessary members. A channel cover 117 is set on the ink channel 116B. A filter 118 for removing bubbles and dust, and an O ring 119 for preventing ink leakage out of the joint portion are disposed at the leading end of the ink supply pipe 116A.

In order to assemble the above head unit, a pin 111P projecting from the base plate 111 is passed through a through hole 115P formed through the PCB 115, and fixed by adhesion or the like. The fixing of the pin 111P and the through hole 115P does not require so high precision. It is because the heater board 112 which should be precisely attached to the base plate 111 is fixed separately from the PCB 115.

Figure 8:
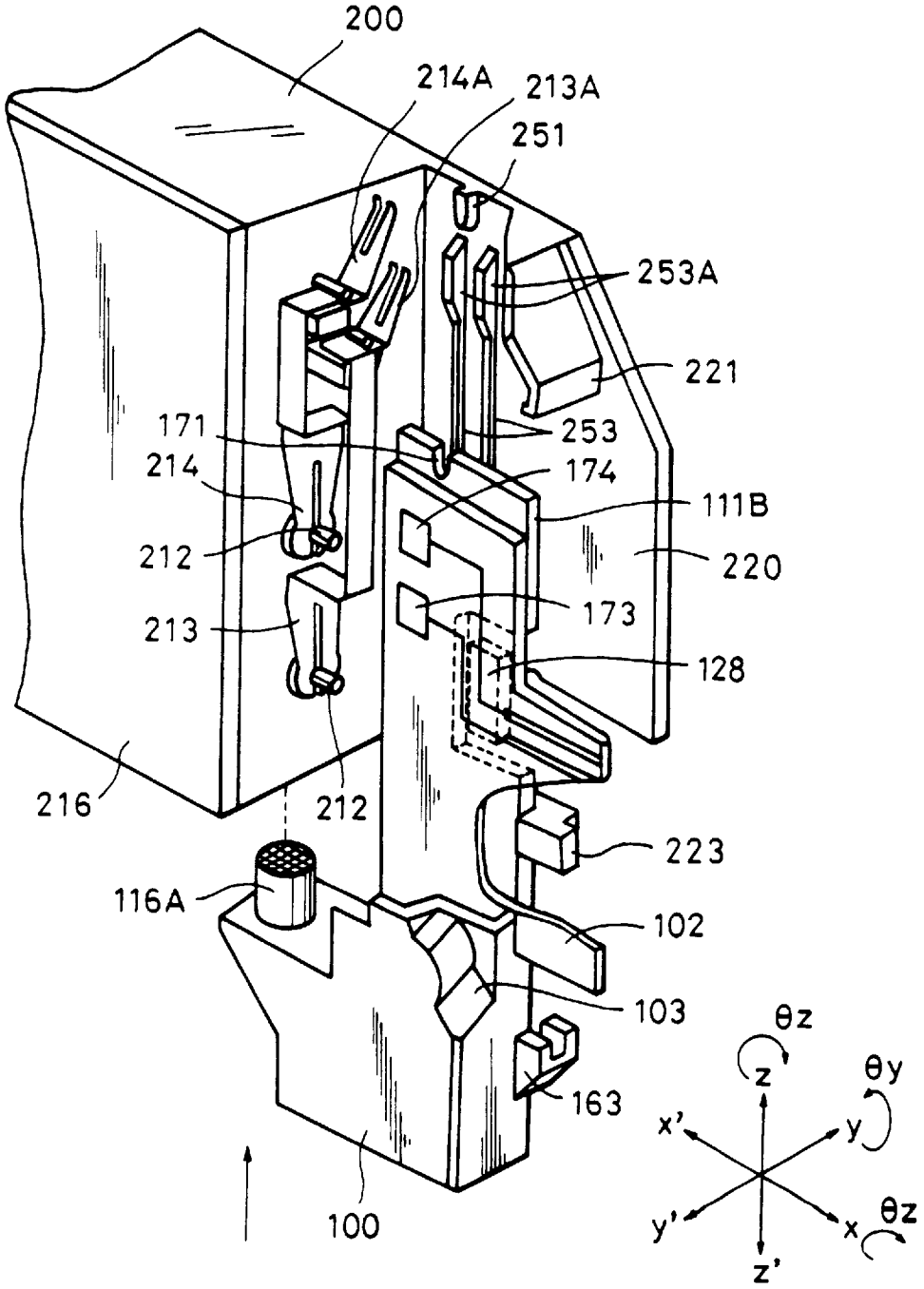
FIG. 8 is a schematically perspective view explaining the operations when the head unit is attached to the ink tank unit.

The heater board 112 is precisely mounted and fixed on the base plate 111, and electrically connected to the PCB 115. After the top plate 113 and the spring 114 are attached, and, if necessary, adhered and sealed, the three pins 116C projecting from the cover 116 are passed through holes 111C of the base plate 111. A head unit is finished by fusing the three pins 116C by heat. Furthermore, a recording head unit shown in FIG. 8 is formed by protecting the above semiconductor device by covering the the exposed side (lower side shown in FIG. 6) of the semiconductor device with a member 222 and so on. Since most parts of the semiconductor device are covered with the member 222 and so on, the head unit can protect the semiconductor device by itself.

An ink tank unit connectable to the above-mentioned recording head unit will be described with reference to the drawings.

(1.3) Ink Tank Unit

Referring to FIG. 4, the ink tank unit 200 is constituted by an ink container 211 serving as the body thereof, an ink absorber 215 for absorbing ink, an ink tank cover 216, and electrode pins 212, for detecting the amount of remaining ink, whose leading ends each are fitted into the ink absorber 215, and sealed and fixed by fusing the bottom thereof on the wall of the container 211. Numerals 213 and 214 denote contact members for the pins 212. These components of the ink tank unit 200 will now be explained.

A cylindrical portion 233 in the ink container 211 is disposed opposite to the ventilating hole 203 and functions as a buffer for preventing the leakage of ink due to the vibration and rocking of the ink tank unit 200.

The ink absorber 215 allows the cylindrical portion 233 to pass therethrough, and has a hole 215A to prevent a compressed area from being formed around the cylindrical portion 233. Since the cylindrical portion 233 is fitted into the hole 215A, the absorber 215 is not compressed by the cylindrical portion 233, and the ink does not remain in a compressed portion under high negative pressure.

(1.4) Loading of Head Unit to Ink Tank Unit

The loading of the head unit 100 to the ink tank unit 200 will be described with reference to FIGS. 6, 7 and 8. FIG. 8 is a partially cutaway schematic view of an embodiment of the loading.

Figure 6:
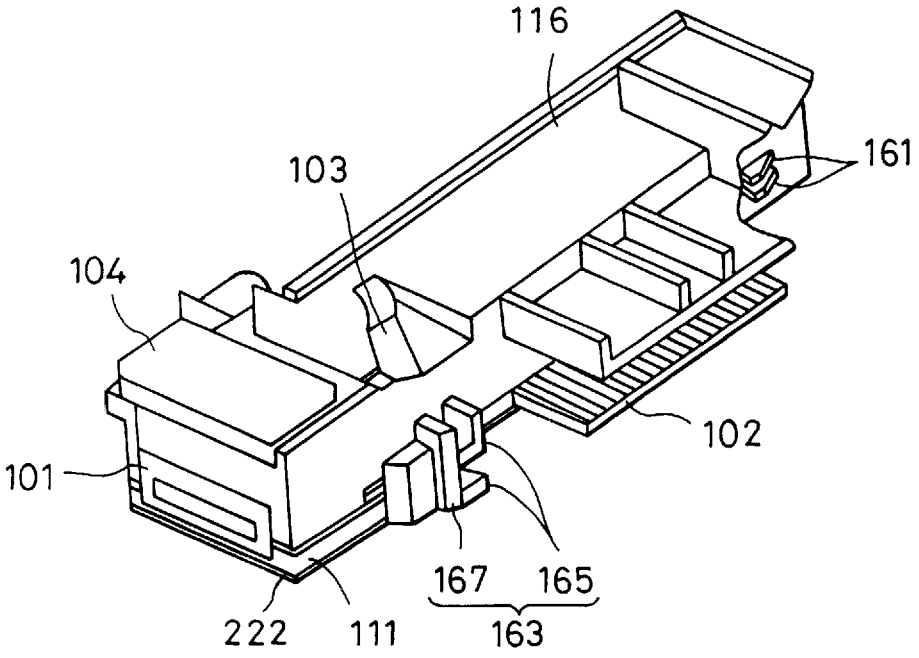
FIG. 6 is a partially cutaway view showing the outside configuration of the head unit.
Figure 7:
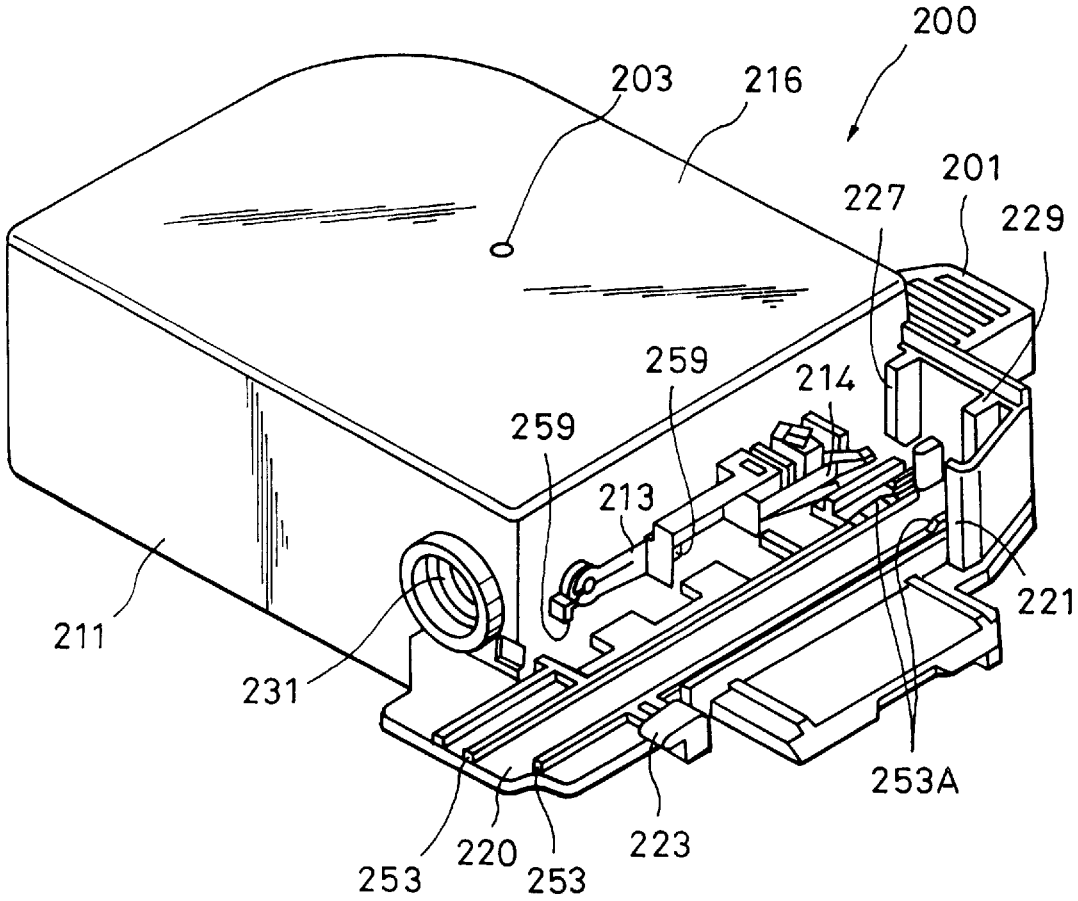
FIG. 7 is a perspective view showing the outside configuration of an ink tank unit.

Referring to FIGS. 6 and 7, numerals 161 and 221 denote a projection formed on the cover 116 of the head unit 100, and a resilient latch formed on the container 211 of the ink tank unit 200, respectively. The engagement of the projection 161 and the latch 221 prevents the head unit 100 from falling. In FIGS. 6, 7 and 8, a mating portion 163 is mounted in the head cover 116, and composed of contact portions 165 and 167 disposed opposite to each other at a predetermined interval. When a fitting portion 223 of the container 211 is fitted into the contact portion 165 and urged against the contact portion 167, the movement of the head unit 100 is regulated in the direction y–y' shown in FIG. 8 and the loading direction (the direction z shown in FIG. 8).

Referring to FIG. 7, the lower portions of regulating members 227 and 229 are engaged with a rear end portion 111B of the base plate 111 when the head unit 100 is loaded, thereby regulating the upward displacement of the head unit 100 (in the direction y' shown in FIG. 8). Furthermore, the displacement of the head unit 100 to the right and left can be regulated by engaging the regulating members 227 and 229 with the rear end of the head unit 100. As shown in FIG. 8, a convex portion 251 formed in the innermost portion of the part where the container 211 is attached to the head unit 100 can be fitted in a concave portion 171 at the rear end of the base plate 111. This fitting regulates the displacement of one end of the base plate 111 to the right and left (in the direction x–x' shown in FIG. 8) when the head unit 100 is loaded.

Rails 253 are disposed on the head unit attachment portion of the container 211 along the loading direction, and convex portions 253A are formed in the innermost portions of the rails 253 so as to slightly displace the head unit 100 upward shown in FIG. 7 (in the direction y' shown in FIG. 8).

On the other hand, the contact members 213 and 214 connected to electrodes 212 and 212 are properly bent so as not to be in contact with each other (although the bending manner shown in FIG. 8 is different from that shown in FIG. 7 to simplify the drawing, either case will do), and extend inwardly in the loading direction of the head unit 100. Leading ends 213A and 214A of the contact members 213 and 214 each are formed in the shape of a plate spring so as to apply urging force in the direction y shown in FIG. 8, and positioned near the convex portion 253A. The PCB 115 is provided with contact faces 173 and 174 capable of being in contact with the leading ends 213A and 214A of the contact members 213 and 214, respectively. In other words, when the head unit 100 is loaded, the head unit 100 is slightly displaced upward shown in FIG. 7 by the convex portions 253A, urged by the contact member leading ends 213A and 214A adjacent to the convex portions 253A in the direction reverse to the above direction, and held while being urged against the convex portion 253A. Since the head unit 100 is elastically urged near the convex portions 253A, it is possible to prevent backlash in the urging direction.

Referring to FIGS. 7 and 8, a regulating member 259 is disposed below the pin 212 and portions of the contact members 213 and 214 other than the leading ends (in the direction y shown in FIG. 8), and can engage the PCB 115 in an adhering operation.

The loading operation of the head unit 100 will be described with reference to FIG. 8.

In the head unit 100 where the semiconductor device is covered with the member 222, as shown in FIG. 6, the bottom of the member 222 is regulated by the slide rails 253. In the head unit 100 where the semiconductor device is not covered, the bottom of the base plate 111 is regulated by the slide rails 253. The head unit cover 116 and the side of the base plate 111 are limited by the side wall of the container 211, and the head unit 100 is slid in the direction indicated by the arrow shown in FIG. 8. Even if the head unit 100 is displaced in the direction y' shown in FIG. 8 during the slide movement, since the regulating member 259 is engaged with the PCB 115, further displacement of the head unit 100 is restricted, and thus the pins 212 and the contact members 213 and 214 are prevented from being damaged by the contact with the PCB 115.

When the head unit 100 is further slid, the leading end 213A of the contact member 213 disposed on this side in the loading direction presses the adjacency of the contact face 174 of the PCB 115, thereby temporarily holding the head unit 100. In this state, the supply pipe 116A faces the supply outlet 231.

When the head unit 100 temporarily held is further pressed in, the contact member leading portion 214A disposed inward in the loading direction is going to be brought into contact with the contact face 174. In this state, the supply pipe 116A is nearly fitted in the supply outlet 231, and the concave portion 171 and the convex portion 251, and the mating portion 163 and the fitting portion 223 are going to engage each other. The latch 221 is beginning to run onto an inclined face of the projection 161.

When the loading operation is completed, the leading ends 213A and 214A are in contact with the contact faces 173 and 174, respectively, and the supply pipe 116A is entirely fitted into the supply outlet 231. The base plate 111 is pressed against the convex portions 253A by an urging force arising from the contact, the displacement of the head unit 100 is regulated in various directions by the engagements of the concave portion 171 and the convex portion 251, the mating portion 163 and the fitting portion 223, the projection 161 and the latch 221, the regulating members 227 and 229 and the base plate 111, and the regulating member 229 and the head cover rear portion 222, and the head unit 100 is loaded into the ink tank unit 200. The regulations in the above directions and the rotational directions $\theta_x$, $\theta_y$ and $\theta_z$ are also related to the engagement of the ink supply pipe 116A and the ink supply outlet 231 besides the above engagements.

Even in the case of the head unit 100 in which the semiconductor device 128 is not entirely covered with the member 222 (shown in FIG. 6), when the head unit 100 is loaded, the semiconductor device 128 is covered with a member 220 of the ink tank unit 200 (it may be integrally formed with the ink tank unit 200). Therefore, when the head unit 100 is loaded, it is possible to prevent the semiconductor device 128 from being damaged and ink from adhering to the semiconductor device 128.

Although the recording head unit 100 and the ink tank unit 200 are separable from each other in this embodiment, they also may be joined in the production process.

When the ink in the ink tank unit 200 runs short, or when one of the units is maintained, the head unit 100 and the ink tank unit 200 can be easily separated by releasing the latch 221 from the projection 161 and sliding the head unit 100 from the ink tank unit 200 in the direction reverse to the loading direction.

According to the above embodiment, since the electrode contact faces are disposed on the inner portion of the PCB 115, the slide distances of the leading ends of the contact members on the PCB 115 can be shortened by positioning the leading ends inwardly in the loading direction. The rails 253 for guiding the sliding head unit 100 make the slide smooth, and function as reinforcing members. Furthermore, since the contact member leading ends 213A and 214A each are in the shape of a plate spring and located near the contact faces of the convex portions 253A to be used as presser members against the contact faces, the contact with the contact face is positively performed, the number of components is decreased, and the head unit 100 can be supported without any great backlash. In addition, since the pins 212 and the contact members 213 and 214 are inserted in a space defined by the head cover 116 and the PCB 115 when the head unit 100 is loaded and the semiconductor devices, such as a memory device, are located in a space covered with the member 217 of the ink tank unit 200, the PCB 115 and the base plate 111, these components can be prevented from displacement and adhesion of ink due to outside factors, and incorrect detections and operations can be avoided.

According to the above construction, the head unit 100 is held without any great backlash with respect to the ink tank unit 200. However, it is not necessary to hold the head unit 100 so tightly so long as the joint state of the ink supply portion is maintained and the positioning precision of the head unit 100 is not lowered by backlash. It is preferable that the degree of backlash be within ±3 $\mu$m (the head unit is fixed after loaded). In other words, it is only necessary that the jetting portion 101 of the head unit 100 be properly positioned when the head unit 100 is loaded into the body of the printer, and that the joint of the head unit 100 and the ink tank unit 200 be secured to the degree in which inconvenience is not caused by the vibration and other influences while the printer is used, for example, leakage of ink from the ink supply portion, damage to the semiconductor device due to the leakage and the backlash of the head unit, and the lowering of positioning precision, described below. In this case, since the head cartridge in this embodiment is temporarily held in the state where the ink tank unit 200 and the head unit 100 do not cause any above inconvenience (in this embodiment, the backlash in the direction y shown in FIG. 8 does not arise), the structures of the engaging portions of the head unit 100 and the ink tank unit 200 and the loading operation can be greatly simplified. This is made even more effective by placing the engaging portions almost behind the head unit 100, that is, on the side opposite to the jetting portion 101.

Figure 9:
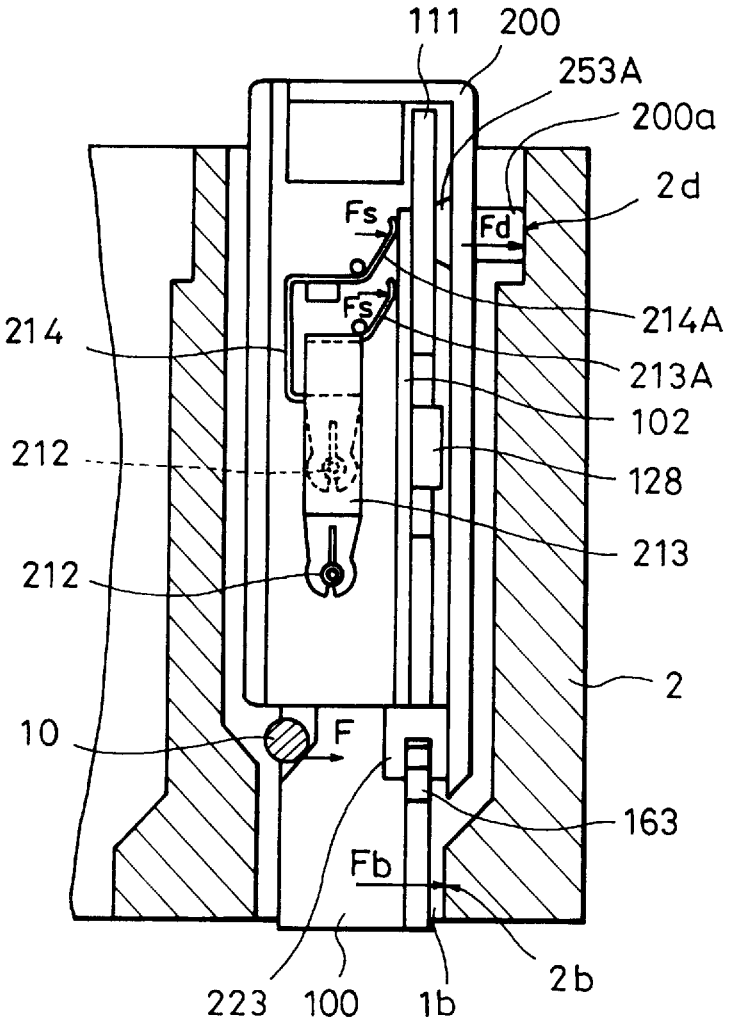
FIG. 9 is a schematic front view explaining the loading state of the head cartridge to the carriage.

FIG. 9 is a front view of the ink jet head cartridge loaded in a carriage 2. The base plate 111 of the head unit 100 is pressed by a contact pressure $F_s$ generated from the contact member leading ends 213A and 214A each in the shape of a plate spring, the contact face of the base plate 111 is brought in contact with the contact face 253A of the ink tank unit 200, and the head unit 100 and the ink tank unit 200 are fixed without any backlash in the pressing direction. The pressure at this time is $F_s \times 2 = 800$ g, and it is sufficient.

In the head cartridge, a contact face 1*b* of the head unit 100 is pressed against a contact face 2*b* of the carriage 2 and a contact face 200*a* of the tank unit 200 is pressed against a contact face 2*d* of the carriage 2 under component forces $F_b$ and $F_d$ generated by a pressure F of a presser pin 10 so as to be positioned. Therefore, it is possible to achieve a precise positioning of the head cartridge including the head unit 100 to the right and left shown in FIG. 9.

Figure 10:
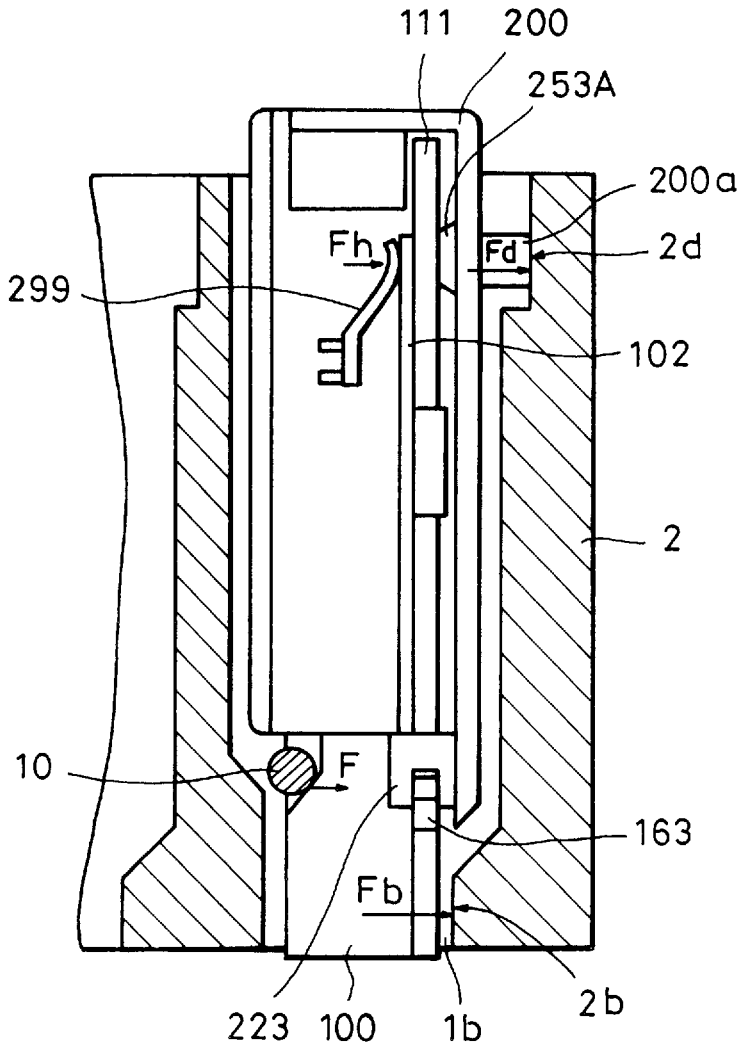
FIG. 10 is a schematic front view explaining the loading state of a head cartridge to a carriage according to another embodiment.

In this embodiment the head unit 100 is pressed against the ink tank unit 200 by elastic forces of the spring-like contact member leading ends 213A and 214 so as to eliminate the backlash of the head unit 100 in the pressing direction and positively position the head unit 100 in the carriage. However, as shown in FIG. 10, another presser member 299 may be disposed instead of using the contact members as presser members. In this case, it is also possible to eliminate the backlash of the head unit 100 to the right and left shown in FIG. 10 and to secure a proper positioning state with respect to the carriage in these directions.

In the above embodiment, a spherical projection is formed on an inclined face of the pin engaging portion 103 on the side of the head unit 100 in order to secure a certain pressure of the pin 10.

In the above case where the semiconductor device is protected by the joint of the recording head and the ink tank unit, the semiconductor device like a memory device is disposed on the side of the recording head unit. However, the main object of the present invention is to protect the semiconductor device and so on from being mechanically damaged or damaged by the adhesion of ink. Therefore, in the case of an ink jet recording head cartridge in which the recording head and the ink tank unit are formed as a unit, the semiconductor device may be placed adjacent to the ink tank so that most parts of the semiconductor device are finally covered with an outer wall or the like.

In this case, for example, a part of the wall of the ink tank unit is composed of two plates and a semiconductor device is disposed between the plates, or a semiconductor device is disposed in a space between the wall of the ink tank unit and the wall covering the recording head unit.

An ink jet recording apparatus loaded with the ink jet recording head and the ink jet recording head cartridge produced according to the above embodiment will now be described with reference to FIG. 11 which is a schematic perspective view showing the principal part of the ink jet recording apparatus.

Figure 11:
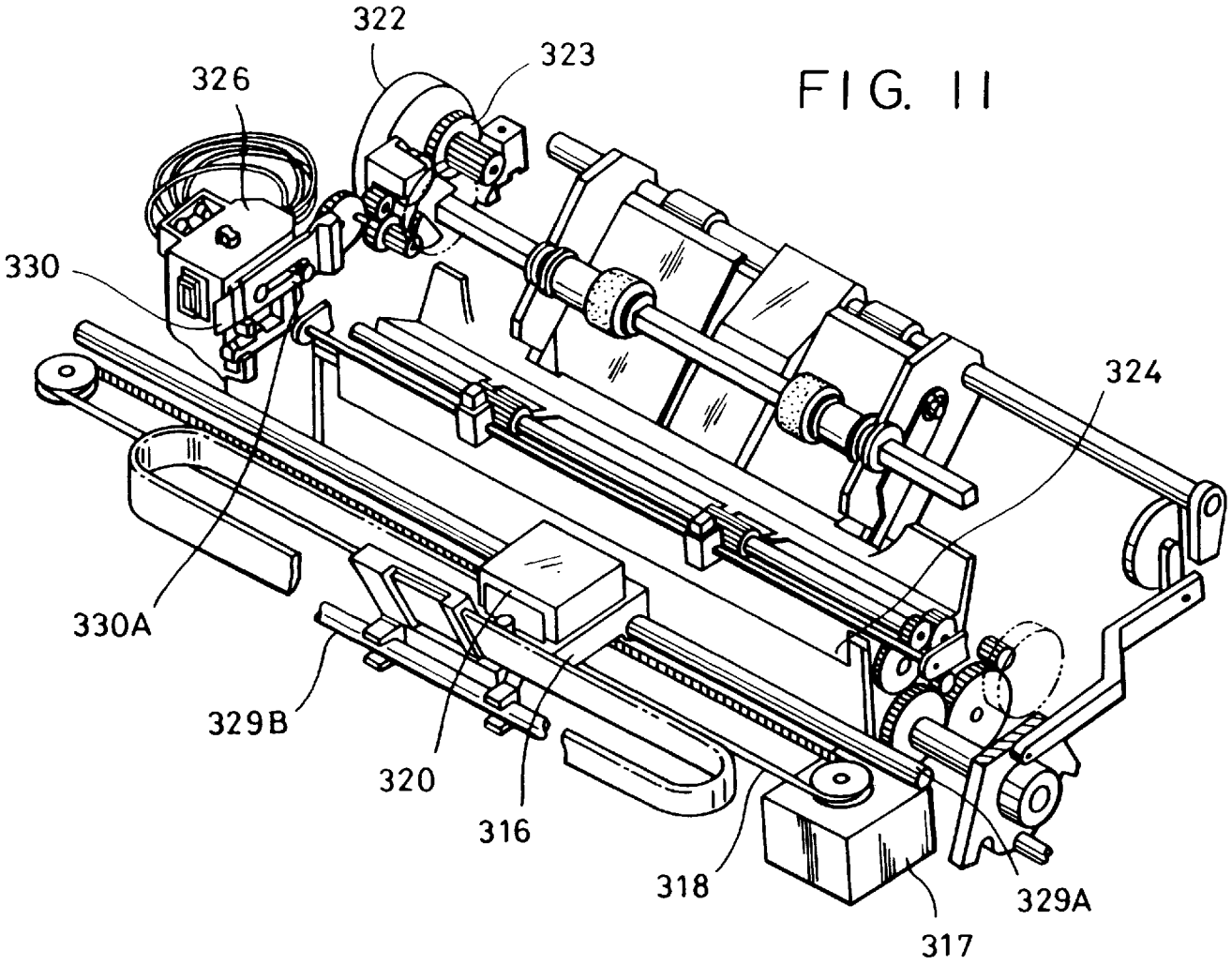
FIG. 11 is a schematic view of a recording apparatus capable of being loaded with the head cartridge of the present invention.

Referring to FIG. 11, a detachable ink jet recording head cartridge 320 integrally has a recording liquid container having a plurality of ink jetting outlets opposite to a recording plane of recording paper (not shown) transported onto a platen 324. A carriage 316 on which the ink jet recording head cartridge 320 is laid is connected to a part of a drive belt 318 for transmitting driving force of a drive motor 317, and slides on two parallel guide shafts 329A and 329B. The above construction enables the ink jet recording head cartridge 320 to reciprocate along the whole width of the recording paper.

A restoration device 326 is disposed in a predetermined position within a movement area of the ink jet recording head cartridge 320, for example, a position opposite to the home position in order to perform restoration and prevention operations with respect to defective ink jetting. The restoration device 326 conducts capping on the jetting outlets of the ink jet recording head cartridge 320 by using the driving force of a motor 322 through a transmission mechanism 323. In correlation to the capping operation of the restoration device 326 for the jetting outlets of the ink jet recording head, ink is sucked from the jetting outlets by an appropriate suction means (not shown) disposed in the restoration device 326. In the case of an apparatus (not shown) where ink is supplied from the body of the apparatus to the recording head, the ink is transported by pressure by an appropriate pressure means (not shown) disposed in the ink supply path connected to the ink jet recording head. Thereby, the restoration process of forcibly ejecting the ink from the jetting outlets and removing alien substances, such as increased-viscosity ink, in the inner parts of the jetting outlets is carried out.

A blade 330 serving as a wiping member made of silicone rubber is disposed on the side of the restoration device 326. The blade 330 is supported by a blade support member 330A in a cantilever manner, is operated by the motor 322 and the transmission mechanism 323 in the same manner as the restoration device 326, and is aligned with the jetting plane of the ink jet recording head. It is thereby possible to project the blade 330 within the movement area of the ink jet recording head, for example, at a proper timing during a recording operation of the ink jet recording head or after a restoration process of the restoration device 326, and to wipe off alien substances, such as condensation and dust, adhered to the jetting plane.

The drive of a recording paper transport means, the carriage, the restoration device and the recording head in the ink jet recording apparatus is controlled according to commands and signals output from a control means including, for example, a CPU in the body of the apparatus.

The control means of the present invention has a function for exchanging information with a memory means of the recording head, and can change drive conditions for the recording head in accordance with information from the memory means and discriminate the type of the recording head.

The present invention brings about excellent effects particularly in a recording head and recording device of an ink jet system utilizing heat energy.

As to a representative constitution and principle of such a system, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives a rapid temperature elevation exceeding nucleate boiling corresponding to the recording information on an electricity-heat converters arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferable discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employing of the conditions described in U.S. Pat. No. 4,313,124 concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned patents, the constitution in use of U.S. Pat. Nos. 4,558,333 and 4,459,600 disclosing the constitution having the heat acting portion arranged in the flexed region is also included in the present invention. In addition, the present invention can be also effectively made with constitution as disclosed in Japanese Patent Laid-Open Application No. 59-123670 which discloses a slit common to a plurality of electricity-heat converters as the discharging portion of the electricity-heat converter or Japanese Patent Laid-Open Application No. 59-138461 which discloses an opening for absorbing pressure wave of heat energy correspondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned documents or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat converters or another heating element or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black etc., but also a device equipped with at least one of plural different colors or full color by color mixing, whether the recording head may be either integrally constituted or combined in plural number.

Furthermore, the form of ink jet recording apparatus according to the invention, in addition to what is used as image output terminal of a data processing apparatus such as computers, may be those of a copying apparatus combined with readers or facsimile apparatus having transmitting and receiving functions.

As described above, according to the present invention, a semiconductor device, such as a memory device, is mounted on a plane of a printed circuit board (PCB) joined to a base plate, and the thickness of the semiconductor device is less than that of the base plate. Therefore, since recording head substrates can be horizontally piled in a container portion like a magazine, the space efficiency is improved and the work supply in an automatic assembly system can be facilitated.

After the semiconductor device is soldered to the PCB, the PCB with the semiconductor device is washed, thereby preventing soldering refuse materials and flux from having a bad influence on a liquid channel, a liquid chamber and an orifice. Therefore, it is possible to provide a recording head substrate having high reliability and achieving stable jetting.

Furthermore, according to the present invention, since an ink supply path of the recording head unit is disposed on the side opposite to the side where the semiconductor device is mounted, leakage of the ink does not have any influence on the semiconductor device.

In the case of a chip-type semiconductor device and a semiconductor device built in a substrate, since they are covered, it is not feared that they will be damaged.

The semiconductor device and so on are protected by the joint of the recording head unit and the ink tank without any special member, and the protection can be achieved by a simple structure.

What is claimed is:

1. An ink jet recording head unit having a jetting outlet for jetting an ink, and an energy generating device for generating energy to jet the ink through said jetting outlet, the recording head unit comprising:

a first substrate having one of a cut-out portion, a slot and a through hole;

a second substrate having said energy generating device, said second substrate being mounted in a predetermined position on said first substrate; and a third substrate having a semiconductor device mounted thereon and being electrically connected to said second substrate, wherein said first and third substrates are joined together with said semiconductor device disposed within said one of said cut-out portion, said slot and said through hole.

2. An ink jet recording head unit according to claim 1, wherein said energy generating device is a heating element for generating heat energy.

3. An ink jet recording head unit according to claim 1, wherein said semiconductor device is mounted to said third substrate by soldering.

4. An ink jet recording head unit according to claim 1, wherein said first substrate has a predetermined thickness, wherein said semiconductor device is disposed wholly within said one of said cut-out portion, said slot and said through hole and has a thickness less than the predetermined thickness of said first substrate.

5. An ink jet recording head unit according to claim 1, wherein said semiconductor device is a memory storing information relating to driving conditions for said energy generating device.

6. An ink jet recording head cartridge having an ink jet recording head unit for recording by jetting an ink and an ink tank for supplying the ink to said recording head unit, said recording head unit and said ink tank being joined together to form the recording head cartridge, said recording head unit comprising:

a substrate having an energy generating device for generating energy to jet the ink through a jetting outlet by applying said energy; and a memory device for storing information relating to the recording head cartridge, said memory device being electrically connected to said substrate, said memory device being disposed in said recording unit, and said memory device being positioned adjacent to said ink tank so that said memory device is covered by said ink tank, wherein said memory device is substantially enclosed by joining said recording head unit and said ink tank.

7. An ink jet recording head cartridge according to claim 6, wherein said energy generating device is a heating element for generating heat energy.

8. An ink jet recording head cartridge according to claim 6, wherein the stored information comprises at least one of driving conditions for said energy generating device and information on a color and a density of the ink in said ink tank.

9. An ink jet recording head cartridge according claim 6, wherein the ink is stored in said ink tank.

10. A recording apparatus comprising:

an ink jet recording head cartridge having an ink jet recording head unit for recording by jetting ink, said ink jet recording head unit comprising a substrate having an energy generating device for generating energy to jet the ink through a jetting outlet by applying energy and a memory device for storing conditions relating to said recording head cartridge electrically connected to said substrate, and an ink tank for supplying the ink to said recording head unit and which is joined together to said recording head unit to cover and enclose said memory device and to form said recording head cartridge; and control means for supplying a signal to said recording head unit to drive said energy generating device.

11. A recording apparatus according to claim 10, wherein said energy generating device is a heating element for generating heat energy.

12. An ink jet recording apparatus for recording by jetting an ink, said apparatus comprising:

an ink jet recording head unit having an energy generating device for generating energy to jet the ink through a jetting outlet by applying the energy, said recording head unit comprising a first substrate having one of a cut-out portion, a slot and a through hole, a second substrate having said energy generating device, said second substrate being mounted in a predetermined position on said first substrate, and a third substrate having a semiconductor device mounted thereon and being electrically connected to said second substrate; and control means for supplying a signal to said recording head unit to drive said energy generating device, wherein said first and third substrates are joined together with said semiconductor device disposed within said one of said cut-out portion, said slot and said through hole.

13. An ink jet recording apparatus according to claim 12, wherein said first substrate of said ink jet recording head unit has a predetermined thickness, wherein said semiconductor device is disposed wholly within said one of said cut-out portion, said slot and said through hole and has a thickness less than the predetermined thickness of said first substrate.

14. An ink jet recording apparatus according to claim 12, wherein the semiconductor device comprises information concerning at least one of a driving condition for said energy generating device, a color of the ink to be jetted, a density of the ink to be jetted, a head shading data, a pulse width modulation control condition and a condition for changing a recording signal.

15. An ink jet recording head cartridge comprising:

an ink jet recording head unit for recording by jetting an ink and an ink tank for supplying the ink to said recording head unit, said recording head unit and said ink tank being joined together to form the recording head cartridge, said recording head unit comprising a first substrate having one of a cut-out portion, a slot and a through hole, a second substrate having said energy generating device, said second substrate being mounted in a predetermined position on said first substrate, and a third substrate having a semiconductor device mounted thereon and being electrically connected to said second substrate, wherein said first and third substrates are joined together with said semiconductor device disposed within said one of said cut-out portion, said slot and said through hole.

16. An ink jet recording head cartridge according to claim 15, wherein the ink is stored in said ink tank.

* * * * *

UNITED STATES PATENT AND TRADEMARK OFFICE

CERTIFICATE OF CORRECTION

PATENT NO. : 5,861,897

DATED : January 19, 1999

INVENTOR(S) : ICHIROH IDE ET AL.

It is certified that error appears in the above-identified patent and that said Letters Patent is hereby corrected as shown below:

On the title page, item:

[54] TITLE

"INKJET" should read --INK JET--; and
"IF" should read --OF--.

[56] REFERENCES CITED (U.S. Patent Documents)

"Kimusa et al." should read --Kimura et al.--.

COLUMN 1

Line 1, "INKJET" should read --INK JET--.
Line 3, "IF" should read --OF--.
Line 43, "density which is" should read --density, and--.
Line 44, "and" should read --which is--.
Line 49, "ing" should read --ing,--.

UNITED STATES PATENT AND TRADEMARK OFFICE

CERTIFICATE OF CORRECTION

PATENT NO. : 5,861,897

DATED : January 19, 1999

INVENTOR(S) : ICHIROH IDE ET AL.

It is certified that error appears in the above-identified patent and that said Letters Patent is hereby corrected as shown below:

COLUMN 5

Line 1, "unit" should read --head unit--.
Line 60, "FIG. 2(c)" should read --FIG 2(d)--.

COLUMN 11

Line 41, Close up right margin.
Line 42, Close up left margin.

Signed and Sealed this

Thirty-first Day of October, 2000

*Attest:*

Q. TODD DICKINSON

*Attesting Officer*

*Director of Patents and Trademarks*